US007594711B2

(12) United States Patent
Sekino et al.

(10) Patent No.: US 7,594,711 B2
(45) Date of Patent: Sep. 29, 2009

(54) RECORDING APPARATUS

(75) Inventors: Takeshi Sekino, Kawasaki (JP); Hisashi Taniguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 570 days.

(21) Appl. No.: 11/408,515

(22) Filed: Apr. 21, 2006

(65) Prior Publication Data

US 2006/0238567 A1 Oct. 26, 2006

(30) Foreign Application Priority Data

Apr. 26, 2005 (JP) ..... 2005-127929

(51) Int. Cl.
*B41J 2/165* (2006.01)

(52) U.S. Cl. ..... 347/29; 347/22

(58) Field of Classification Search ..... 347/29, 347/36, 37, 22

See application file for complete search history.

(56) References Cited

U.S. PATENT DOCUMENTS 5,870,115 A * 2/1999 Kikuchi et al. ..... 347/32
6,042,215 A 3/2000 Imai
6,260,943 B1 * 7/2001 Ishikawa ..... 347/32
6,565,189 B2 5/2003 Yamada et al.

FOREIGN PATENT DOCUMENTS

JP 10-076679 A 3/1998

* cited by examiner

*Primary Examiner*—Julian D Huffman
*Assistant Examiner*—Jason S Uhlenhake
(74) *Attorney, Agent, or Firm*—Canon USA Inc IP Div

(57) ABSTRACT

A recording apparatus including a recording head detachably attached on a carriage and a preliminary-discharge receiving unit. The recording head is movable such that an ink discharge surface is movable by a detachable/attachable moving distance in the direction of ink discharge when the recording head is detached from and attached to the carriage. The preliminary-discharge receiving unit is formed such that the distance to the ink discharge surface of the recording head attached on the carriage is set to be a predetermined preliminary discharge distance. The detachable/attachable moving distance is larger than the preliminary discharge distance.

17 Claims, 9 Drawing Sheets

RECORDING APPARATUS

BACKGROUND OF THE INVENTION

1. Field of the Invention

The present invention relates to a recording apparatus for recording an image and the like on a recording medium (e.g., recording paper). In particular, the present invention relates to a recording apparatus for recording by discharging ink droplets from a recording head detachably attached on a carriage which is movable along the recording medium.

2. Description of the Related Art

Recently, as personal computers and digital cameras have become widespread, the handleability of image information has been increased, thus increasing the demand for uncomplicated recording apparatuses used to output such image information. Among various recording methods used in such recording apparatuses, inkjet recording is known as a recording method that allows a relatively small recording apparatus and achieves inexpensive and high-definition recording.

In a recording apparatus using such an inkjet recording method, an inkjet head cartridge, in which a recording head having a nozzle portion composed of several tens to several hundreds of discharge openings and an ink tank for supplying ink to the recording head are integrally formed with each other, is detachably attached to a carriage. The carriage is connected to a part of a driving belt for transmitting a driving force of a carriage driving motor so as to be movable. The movement of the carriage moves the inkjet head cartridge along a platen arranged opposite a discharge surface. During the movement, the inkjet head cartridge reciprocates (scans) along the full width of a recording medium transported onto the platen to perform recording. The recording medium is conveyed a predetermined distance determined according to the pitch of the nozzle portion by a conveying unit with every scanning of the carriage. Repeating such a scanning of the carriage and a conveyance of the recording paper completes recording on the entire area of the recording medium.

Some inkjet recording apparatuses using a recording unit (e.g., recording head or inkjet head cartridge) detachably attached on a carriage, when ink within an ink tank runs out or the recording head is broken, can easily return to a state capable of recording by replacing the recording unit with a new one.

Furthermore, some inkjet recording apparatuses can output (record) a photographic image with good photographic quality by including high-density and high-quality discharge openings (nozzles) for discharging ink on, for example, a recording head integrally formed with an inkjet head cartridge. Moreover, some inkjet recording apparatuses have become widely available in which the speed of an image output is further enhanced by a long recording head having an increased number of nozzles.

Some conventional inkjet recording apparatuses typically eliminate clogging (e.g., paper dust or thickened ink within nozzles) by moving a recording head to a preliminary discharge position after recovery processing performed by a recovery unit or when a carriage scans during recording and then performing preliminary discharge predetermined times in order to maintain the quality of recording by the recording head. At the preliminary discharge position, a waste-ink absorber is arranged opposite a nozzle surface so that the waste-ink absorber absorbs ink droplets dropped by performing preliminary discharge toward a preliminary-discharge receiving opening.

The conventional structure has a problem of accumulation of crud inside the apparatus caused by ink mist splashing off the preliminary-discharge receiving opening and ink mist flowing and spreading from between the preliminary discharge receiving opening and the waste-ink absorber and crud inside the apparatus caused by ink mist generated while a recording paper is recorded on.

As one approach to address the problem, a structure that suppresses the generation of ink mist by providing a waste-ink absorber and a preliminary discharge receiving mechanism that can control the flow of ink mist is discussed in U.S. Pat. No. 6,565,189.

However, the conventional preliminary discharge receiving mechanism discussed in U.S. Pat. No. 6,565,189 may have a problem of a significantly large unevenness of obtained advantageous effects because the control of the flow of ink mist depends on the characteristics of a material of the waste-ink absorber and the acuteness of an incident angle of an ink droplet against the surface of the waste-ink absorber. Additionally, this traditional structure may have the drawback of a high cost of manufacturing because the waste-ink absorber is limited to a significantly narrow range of materials.

Furthermore, the conventional inkjet recording apparatus described above is prone to generate ink mist because the apparatus absorbs ink mist due to a preliminary-discharge receiving opening arranged in a platen, in which the gap between the platen and a recording head is relatively large, and therefore, the travel distance of ink droplets through the air from a nozzle portion to the preliminary-discharge receiving opening is increased.

SUMMARY OF THE INVENTION

The present invention is directed to a recording apparatus, a preliminary-discharge receiving unit, and a recording head that are capable of reducing the generation of ink mist with an inexpensive and simple structure.

According to one aspect of the present invention, a recording apparatus includes a carriage capable of reciprocating with respect to a recording medium, a recording head detachably attached on the carriage, the recording head being movable such that an ink discharge surface of the recording head is movable by a first moving distance in a direction of ink discharge when the recording head is detached from or attached to the carriage, and a preliminary-discharge receiving unit disposed at a position opposite the ink discharge surface of the recording head when the recording head attached on the carriage moves to a preliminary discharge position for performing preliminary discharge. A distance between the preliminary-discharge receiving unit and the ink discharge surface is smaller than the first moving distance. The preliminary-discharge receiving unit is movable in the direction of the ink discharge. The preliminary-discharge receiving unit is in contact with the ink discharge surface and moves in a direction remote from the carriage when the recording head is detached or attached.

Further features of the present invention will become apparent from the following description of exemplary embodiments with reference to the attached drawings.

DESCRIPTION OF THE EMBODIMENTS

An exemplary embodiment of the present invention is described below with reference to the drawings.

FIGS. 1 to 3 and 4A and 4B show an inkjet recording apparatus including a carriage and an inkjet head cartridge attached on the carriage, the carriage and inkjet head cartridge constituting a recording unit. The inkjet recording apparatus performs recording on a recording medium by discharging ink from the recording unit.

Figure 1:
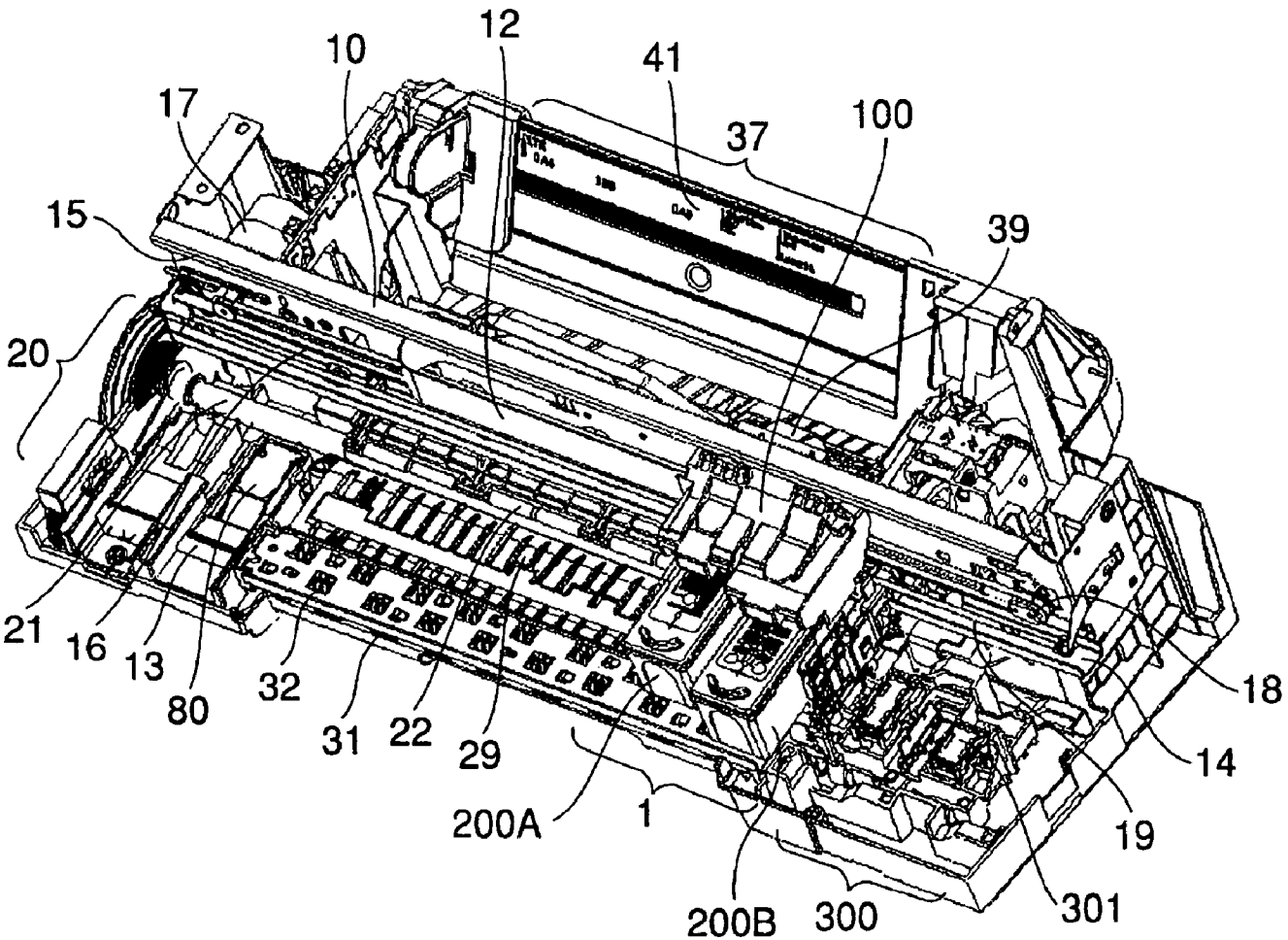
FIG. 1 is a perspective view showing a general structure of an inkjet recording apparatus according to an exemplary embodiment of the present invention.

FIG. 1 is a perspective view showing a general structure of the inkjet recording apparatus. As shown in FIG. 1, the inkjet recording apparatus according to the exemplary embodiment mainly includes a feeding unit 37 for feeding a recording sheet as a recording medium, a conveying unit 20 for conveying the recording sheet, a recording unit 1 for performing recording on the recording sheet conveyed by the conveying unit 20, and a maintenance unit 300 for recovering the discharge characteristics of a recording head included in an inkjet head cartridge included in the recording unit 1. Although not shown, the inkjet recording apparatus receives recording data from a host apparatus, stores the recording data in a control unit on a control board, issues a command to start a recording operation from the control unit, and starts the recording operation in response to the command.

When the recording operation starts, a feeding operation is first carried out. The feeding unit 37 can be a main automatic sheet feeder (ASF) and constitutes an automatic feeder which grabs a recording sheet from multiple sheets (not shown) stacked on a pressure plate 41 sheet by sheet every recording operation and feeds the recording sheet to the conveying unit 20.

The recording sheet fed from the feeding unit 37 is conveyed toward a nip unit composed of a conveying roller 21 and a pinch roller 22 which constitute the conveying unit 20. Then, a driving force transmitted to a feeding roller 39 is stopped, and the feeding roller 39 rotates so as to follow the recording sheet. At this point, the recording sheet is conveyed by only the conveying roller 21 and the pinch roller 22. The recording sheet is forwarded in the normal direction, every quantity corresponding to a predetermined linefeed width, and is advanced along a lib on a platen 29. The leading end of the recording sheet in the direction of feeding is gradually caught by a nip unit composed of a first eject roller 31 and a first spur group 32. The peripheral velocity of the first eject roller 31 is set to be substantially equal to that of the conveying roller 21. The conveying roller 21 is connected to the first eject roller 31 with a gear train disposed therebetween, so that the first eject roller 31 is rotated in synchronization with the conveying roller 21. Therefore, the recording sheet is smoothly conveyed without being bent or stretched.

The recording unit 1 mainly includes a black ink inkjet head cartridge 200A, a three-color ink inkjet head cartridge 200B, both cartridges functioning as a recording unit in which a recording head and an ink tank are formed integrally with each other, (hereinafter referred to simply as cartridges 200A and 200B, respectively), and a carriage 100 for mounting the cartridges 200A and 200B and scanning in a direction that intersects (typically, is perpendicular to) the direction of conveying the recording sheet. The carriage 100 is supported and guided by a guide rail 14 secured to a chassis 10 and a support rail 15, which is part of the chassis 10. The carriage 100 is reciprocated by receiving a driving force from the a carriage motor 17 via a carriage belt 16 extending between the carriage motor 17 and an idler pulley 18.

Figure 4A:
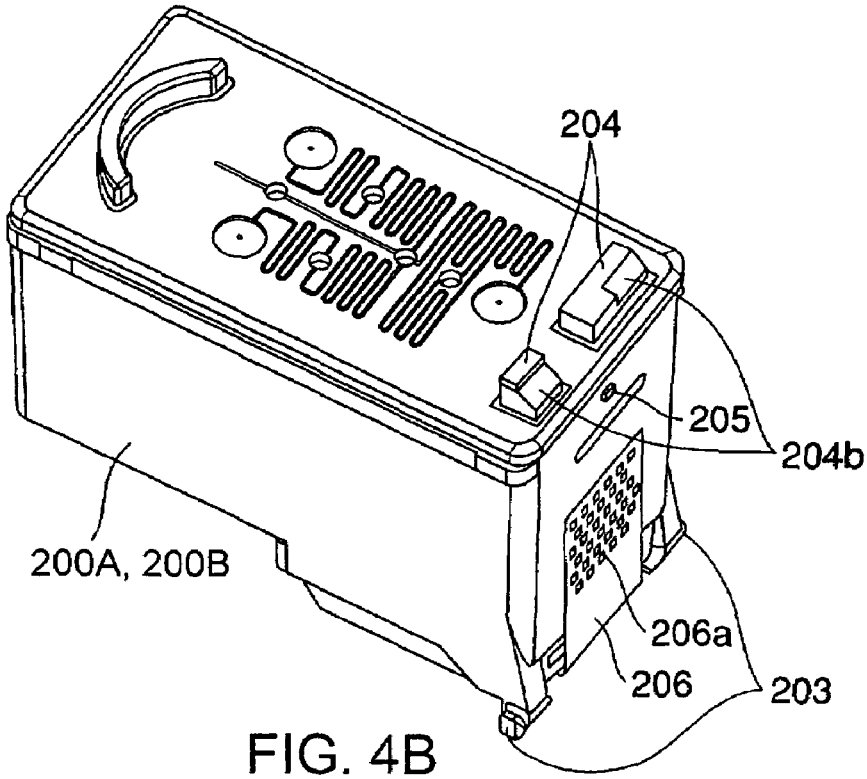
FIGS. 4A and 4B are perspective views of the inkjet head cartridge.
Figure 4B:
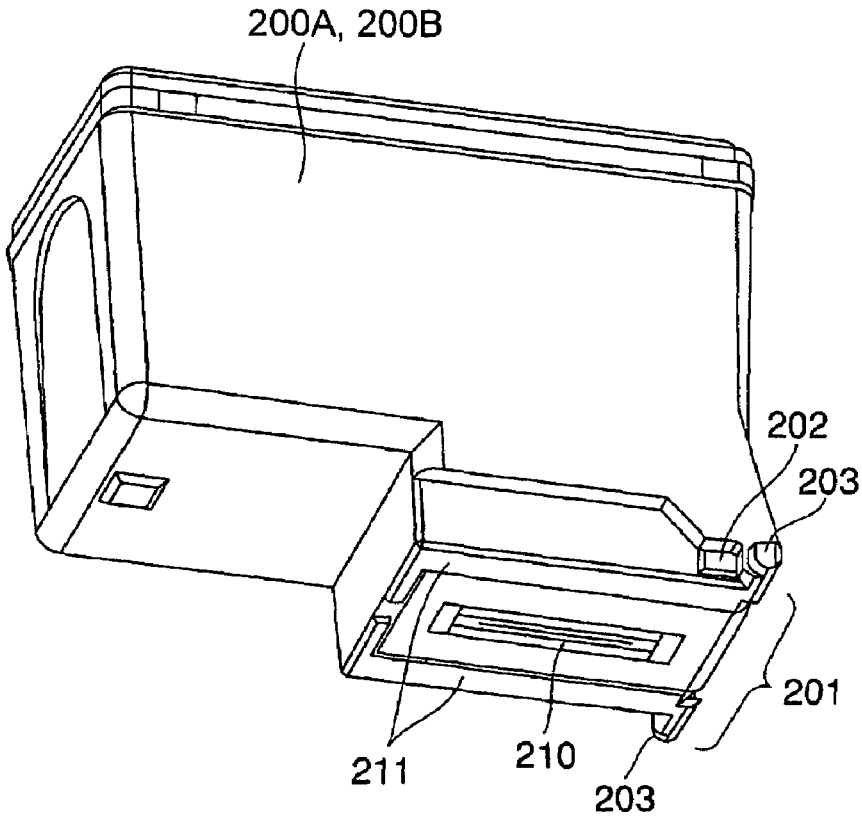

Inside the cartridges 200A and 200B, a plurality of ink paths (not shown) is formed. The ink paths communicate with nozzles (discharge openings) 210 disposed in an ink discharge surface 201 arranged opposite the platen 29, as shown in FIGS. 4A and 4B. Inside each of the plurality of nozzles 210, which constitute a series of nozzles, an actuator (energy generating unit) for discharging ink is arranged. Examples of the actuator include an actuator that uses fluid pressure in film boiling caused by electrothermal conversion member (heating element) and that uses an electromechanical transducer (electro-pressure converting element) (e.g., piezoelectric element).

Figure 3:
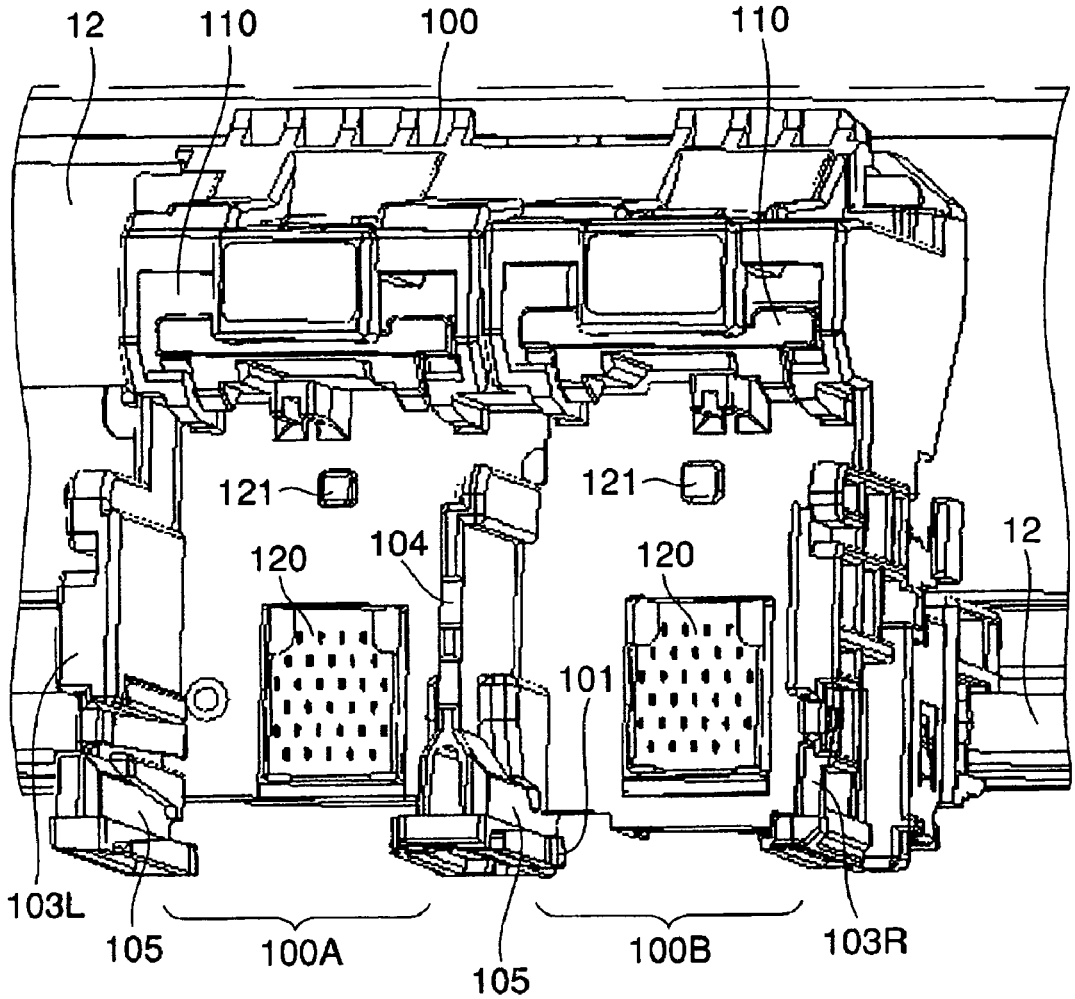
FIG. 3 is a perspective view of the carriage before the inkjet head cartridge is attached thereto.

In order to electrically connect the cartridges 200A and 200B to a main body of the recording apparatus, each of the cartridges 200A and 200B includes a flexible printed circuit (FPC) 206 having conductor exposing portions 206*a* to which no resist is applied. As shown in FIG. 3, the carriage 100, on which the cartridges 200A and 200B are attached, includes pressure welding connectors 120 formed from a plated metal material. The pressure welding connectors 120 are pressure-welded to the conductor exposing portions 206*a* of the cartridges 200A and 200B by using an elastic deformation of the metal material for electrical connection to the conductor exposing portions 206*a*. Additionally, the pressure welding connectors 120 are soldered to a carriage substrate (not shown) attached on the carriage 100. The carriage substrate is electrically connected to a circuit board (control circuit) in the main body of the recording apparatus with a flexible flat cable (FFC) 12 disposed therebetween.

In the inkjet recording apparatus described above, in response to a driving signal received in each of the cartridges 200A and 200B from a head driver (not shown) via the FFC 12, the recording head of each of the cartridges 200A and 200B discharges an ink droplet in accordance with recording data.

As shown in FIG. 1, a code strip 19 extending on the chassis 10 is read by using a carriage encoder (not shown) mounted on the carriage 100, thereby discharging an ink droplet to the recording sheet with appropriate timing. In such a way, after a recording operation for a single line on the recording sheet has completed, the recording sheet is conveyed a necessary amount by the conveying unit 20. Repeating this operation allows recording to be performed on the entire area of the recording sheet. The schematic structure of the inkjet recording apparatus is described above.

Figure 2:
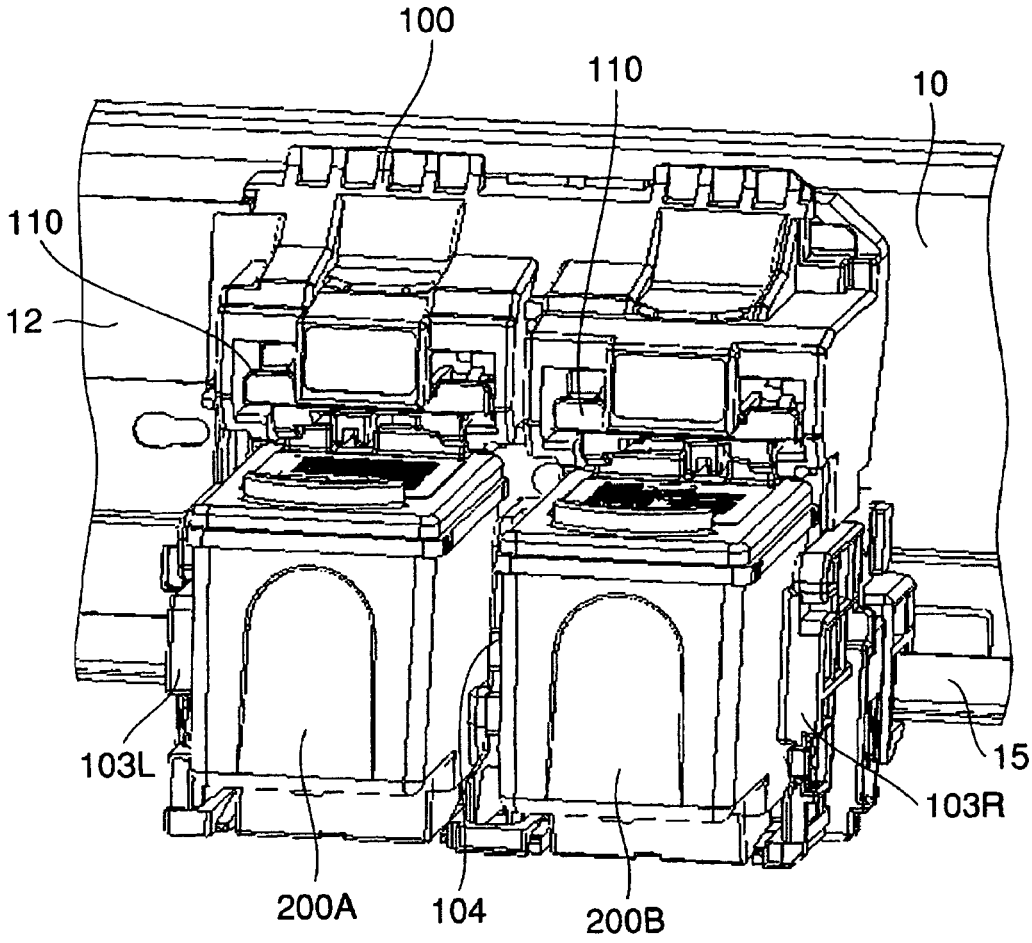
FIG. 2 is a perspective view of a carriage and an inkjet head cartridge attached on the carriage.

FIG. 2 is a perspective view of the carriage 100 and the cartridges 200A and 200B when the cartridges 200A and 200B are attached to the carriage 100. FIG. 3 is a perspective view of the carriage 100 with the cartridges 200A and 200B removed.

As shown in FIGS. 2 and 3, the carriage 100 is provided with side walls 103L and 103R on opposite sides of the cartridges 200A and 200B in the direction of scanning and a middle wall 104 for partitioning an area into spaces for the cartridges 200A and 200B. A first cartridge attaching portion 100A for allowing the cartridge 200A to be attached thereto is disposed between the side wall 103L and the middle wall 104, and a second cartridge attaching portion 100B for allowing the cartridge 200B to be attached thereto is disposed between the side wall 103R and the middle wall 104. FIGS. 1 and 2 illustrate a state in which the cartridges 200A and 200B are attached to the carriage 100.

In the carriage 100, the middle wall 104 is provided with a thickened portion at each of the bottoms of opposite sides thereof, and each of the side walls 103L and 103R is provided with a thickened portion at the bottom of the inner side thereof. Each of these thickened portions is provided with a positioning protrusion 101 for engaging positioning slots 202 of the cartridges 200A and 200B.

The carriage 100 is provided with the pressure welding connectors 120 for electrical connection to the cartridges 200A and 200B by being in contact with the conductor exposing portions 206*a* of the FPCs 206 of the cartridges 200A and 200B. The carriage 100 is provided with head set cams 110 functioning as a securing member for facilitating the installation and securement of the cartridges 200A and 200B. The head set cams 110 are pressed downward by an urging force applied by head set springs 111 which can be compression coil springs.

FIGS. 4A and 4B are perspective views of the cartridge. As described above, the cartridge in the exemplary embodiment is a replaceable inkjet head cartridge in which an inkjet recording head and an ink reservoir (ink tank) are formed integrally with each other. In the case of normal color recording, as the cartridge, the cartridge 200A for a black ink is attached to the first cartridge attaching portion 100A, and the cartridge 200B for three colors of ink (cyan, magenta, and yellow) is attached to the second cartridge attaching portion 100B. In the case of photographic color recording with photographic quality, in place of the black-ink cartridge, an optional photo cartridge (black, light cyan, and light magenta), not shown, can be used. The cartridges 200A and 200B have substantially the same outer dimensions as the photo cartridge.

As shown in FIGS. 4A and 4B, the cartridge 200A includes one or more head press receiving portions 204 on the top thereof and at an end adjacent to the conductor exposing portions 206*a*. Each of the head press receiving portions 204 includes a cam rotation slope 204*b* for facilitating rotation of the head set cam 110 shown in FIG. 3 at a surface facing the end adjacent to the conductor exposing portions 206*a*. The cartridge 200A includes the positioning slots 202 for being positioned in place with respect to the first cartridge attaching portion 100A on the bottoms at both sides thereof. The cartridge 200A includes rough guide projections 203 disposed more to the front than the positioning slots 202 on the end adjacent to the conductor exposing portions 206*a* at both sides thereof.

The recording head of each of the cartridges 200A and 200B includes one or more nozzle protectors 211 for protecting the nozzles 210 from coming into contact with a recording sheet resulting from a warp of the recording sheet fed from the feeding unit 37 or the like such that the nozzles 210 in the ink discharge surface 201 is disposed between the nozzle protectors 211. The nozzle protectors 211 slightly protrude in the direction of ink discharging more than the nozzles 210.

Therefore, even when the recording sheet approaches the nozzles 210 resulting from a warp of the sheet or the like, the nozzle protectors 211 come into contact with the recording sheet before the nozzles 210 do so. Therefore, the possibility that the nozzles 210 might come into contact with a recording sheet is reduced to a minimum. In other words, the nozzle protectors 211 prevent the nozzles 210 from being damaged by coming into contact with the recording sheet or a preliminary-discharge receiving unit (described later).

Figure 8:
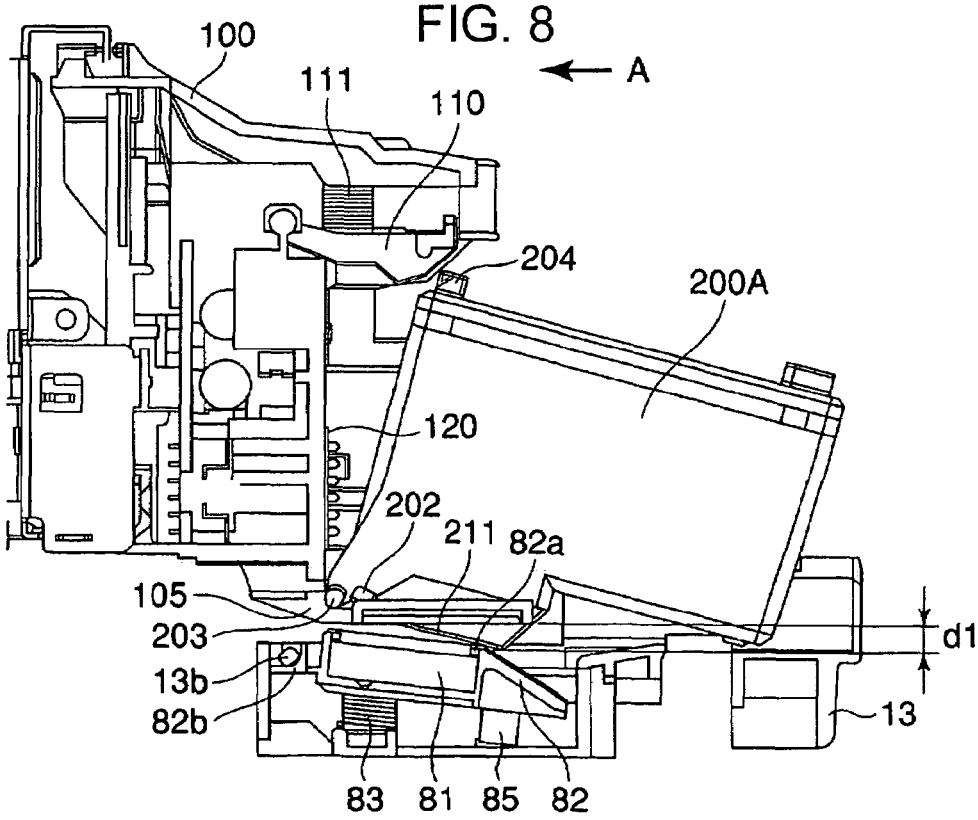
FIG. 8 is a section view showing a second state in the process of attaching the inkjet head cartridge.

As shown in FIG. 8, the recording head of each of the cartridges 200A and 200B is movable such that the ink discharge surface 201 is movable by a predetermined detachable/attachable moving distance d1 in the direction of ink discharge when the cartridges 200A and 200B are detached from or attached to the first cartridge attaching portion 100A and second cartridge attaching portion 100B of the carriage 100, respectively. The detachable/attachable moving distance d1 of the recording head is larger than a preliminary discharge distance d2 of a preliminary-discharge receiving unit 80, which is described below.

A maintenance operation for the recording head to avoid the recording unit 1 from performing poor recording is described next. The maintenance unit 300 included in the inkjet recording apparatus is disposed at the right part in the recording apparatus shown in FIG. 1. The maintenance unit 300 includes a blade 301 for wiping ink or the like on a discharge opening surface (the surface where the discharge openings are formed) of the recording head when the recording head of the cartridge moves during scanning of the carriage, a capping member for selectively adhering closely to the discharge opening surface of the waiting recording head, a pump for performing a sucking operation via a through-hole of the capping member, and a main absorber (not shown) for absorbing and holding ink sucked by the pump.

Figure 10:
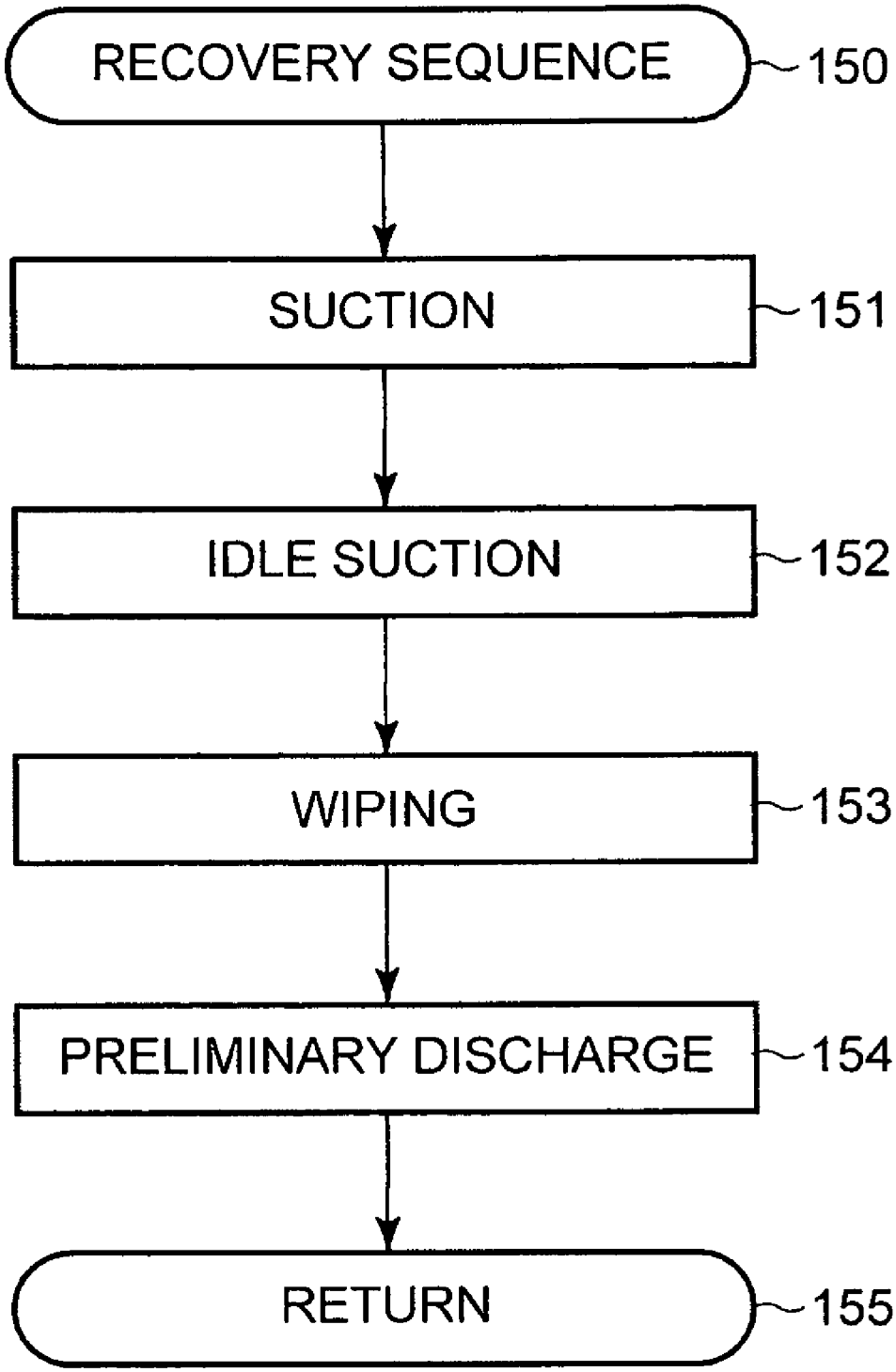
FIG. 10 is a flowchart of one example of a recovery operation performed by a maintenance unit.

The maintenance unit 300 performs a recovery operation including a sequence of steps of suction, idle suction, wiping, and preliminary discharge (steps 150 to 155) shown in the flowchart of FIG. 10, thus avoiding the recording head of each of the cartridges 200A and 200B from performing poor recording caused by a clogging of the nozzle or the like.

During the recovery operation, the recording head of each of the cartridges 200A and 200B is moved up to a preliminary discharge position (described below) and a preliminary discharge is performed, which has no direct bearing on recording on a recording sheet, thus eliminating the cause of clogging (e.g., paper dust or thickened ink within nozzles).

As another example, when an image with only a specific color is recorded, only a specific ink is used, and therefore, only a specific nozzle is used. In such a case, clogging caused by, for example, paper dust or thickened ink may occur in an unused nozzle during the recording operation. To address this problem, it is necessary to move the recording head of each of the cartridges 200A and 200B up to the preliminary discharge position and perform a preliminary discharge even during the recording operation. In consideration of this case, the preliminary discharge position is required to be arranged outside a recording operation area of the recording head.

Figure 5:
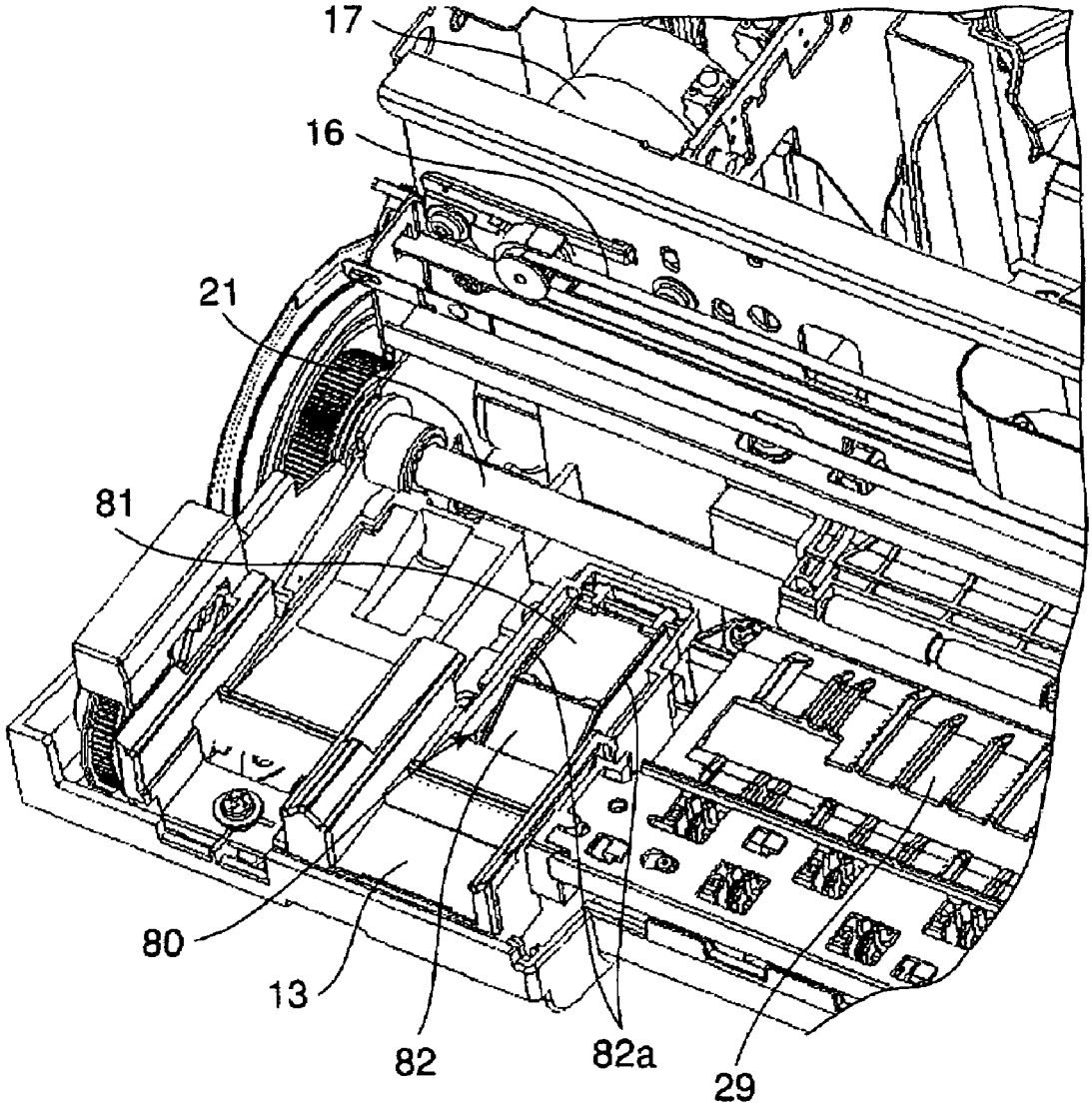
FIG. 5 is a perspective view of a preliminary-discharge receiving unit and its surroundings in the inkjet recording apparatus according to an exemplary embodiment.
Figure 6:
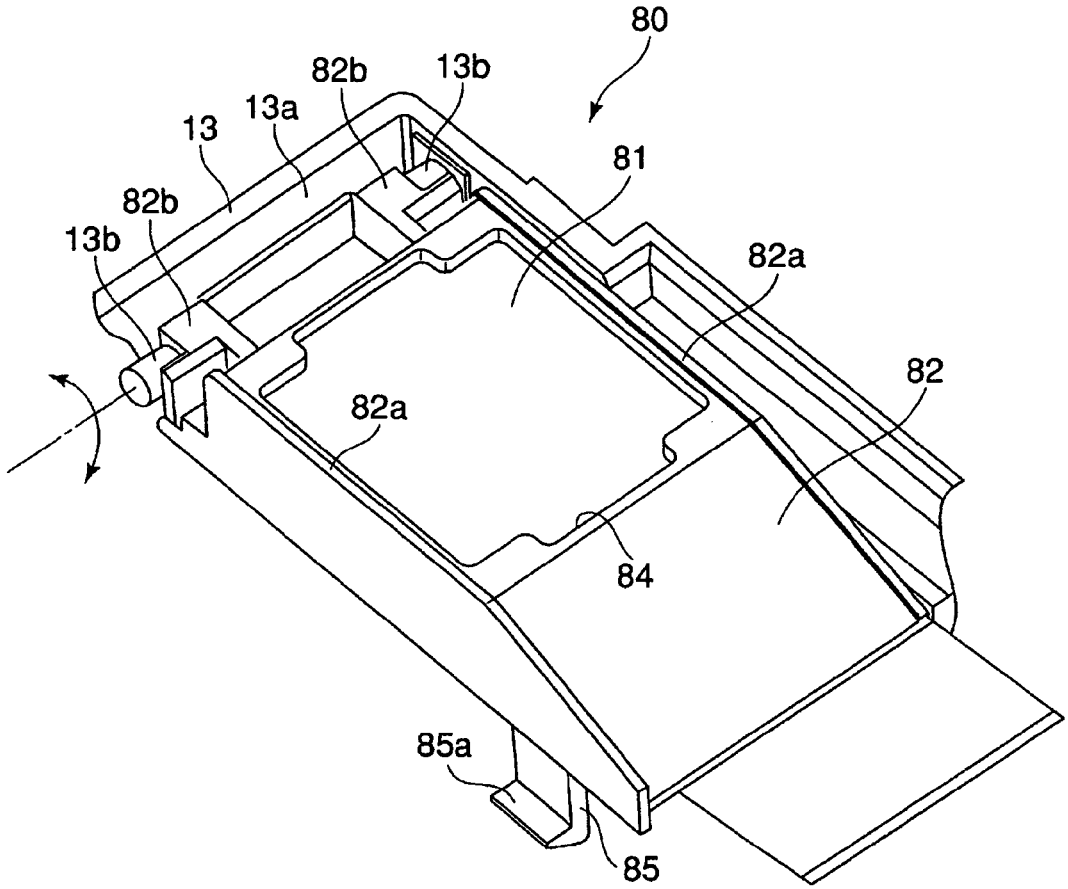
FIG. 6 is a perspective view of the preliminary-discharge receiving unit.

FIG. 5 is a perspective view of a preliminary-discharge receiving unit at the preliminary discharge position and its surroundings. FIG. 6 is a perspective view of the preliminary-discharge receiving unit.

As shown in FIGS. 5 and 6, the preliminary discharge position is substantially the same as a position where the recording head is replaced with a new one (i.e., position where the recording head is detached from or attached to the carriage) arranged outside the recording operation area of the recording head.

The preliminary-discharge receiving unit 80 is disposed opposite the direction of discharging performed by the recording unit 1. The preliminary-discharge receiving unit 80 includes a waste-ink absorber 81 for absorbing an ink droplet of a preliminary discharge performed by the recording head, an absorber holder 82 for holding the waste-ink absorber 81, the absorber holder 82 being provided with a preliminary-discharge receiving opening 84 for receiving the ink droplet of the preliminary discharge, and a compression coil spring 83 functioning as an elastic (resilient) member for urging the absorber holder 82 in a direction adjacent to the nozzles of the recording head.

In the vicinity of the preliminary-discharge receiving unit 80, as shown in FIG. 5, at the position of replacing the recording head, a head supporting base 13 functioning as a guiding member for attaching the recording head to the carriage 100 is disposed.

As shown in FIG. 6, the head supporting base 13 includes an opening 13*a* for exposing the waste-ink absorber 81 held in the absorber holder 82 to the recording head of each of the cartridges 200A and 200B attached on the carriage 100. The head supporting base 13 includes a boss 13*b* for rotatably supporting the absorber holder 82 such that the boss 13*b* is formed integrally with the head supporting base 13 so as to project therefrom.

Figure 7:
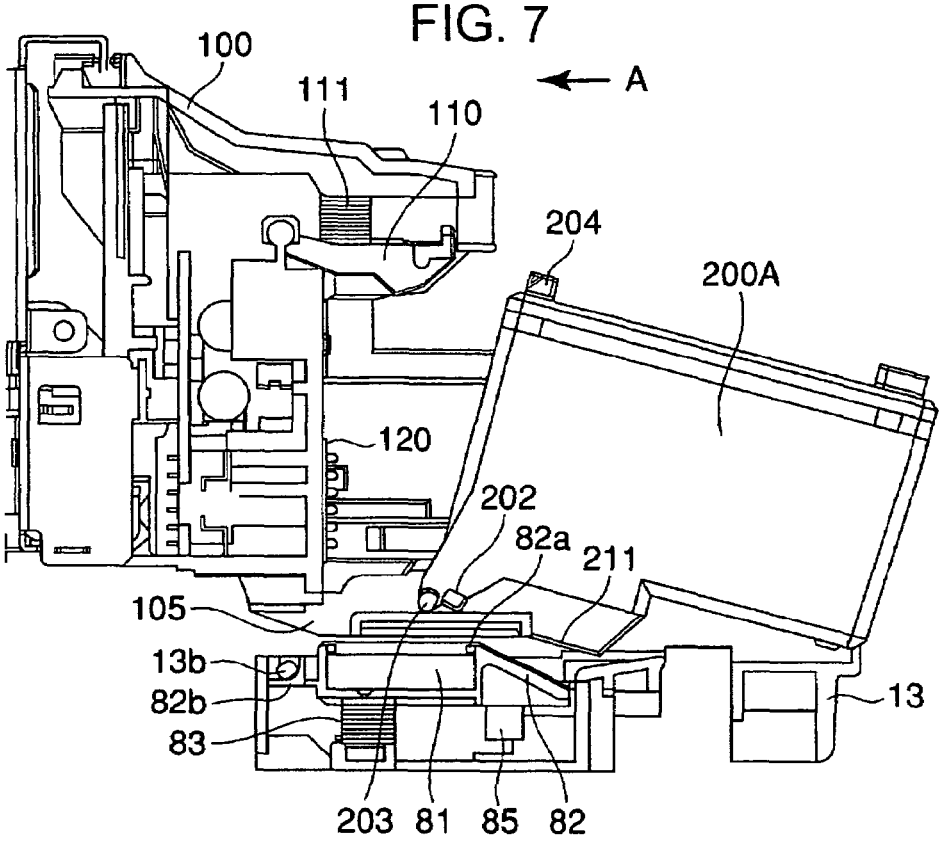
FIG. 7 is a section view showing a first state in a process of attaching the inkjet head cartridge.

As shown in FIGS. 6, 7, and 8, the absorber holder 82 holds the waste-ink absorber 81 and includes the preliminary-discharge receiving opening 84 for exposing the waste-ink absorber 81 to the carriage 100. At the edge of the preliminary-discharge receiving opening 84, a set of linear guide abutting portions 82*a* are formed on the opposite sides of the preliminary-discharge receiving opening 84.

The absorber holder 82 includes a bearing 82*b* for engaging the boss 13*b* of the head supporting base 13 at an upstream position in the direction of conveying a recording sheet. Therefore, the absorber holder 82 is supported so as to be rotatable about the boss 13*b* engaging the bearing 82*b*, thereby allowing the absorber holder 82 to be movable in directions that are adjacent to and remote from the carriage 100.

On the outer region of the absorber holder 82, at a downstream position in the direction of conveying the recording sheet, an engagement lug 85 including a position regulating surface 85*a* for regulating the rotation position of the absorber holder 82 about the boss 13*b* is disposed. The engagement lug 85 movably engages an engagement slot (not shown) formed in the head supporting base 13. The position regulating surface 85*a* engages the inner wall of the engagement slot, thereby regulating the rotation position of the absorber holder 82 rotated by an urging force applied by the compression coil spring 83.

Figure 9:
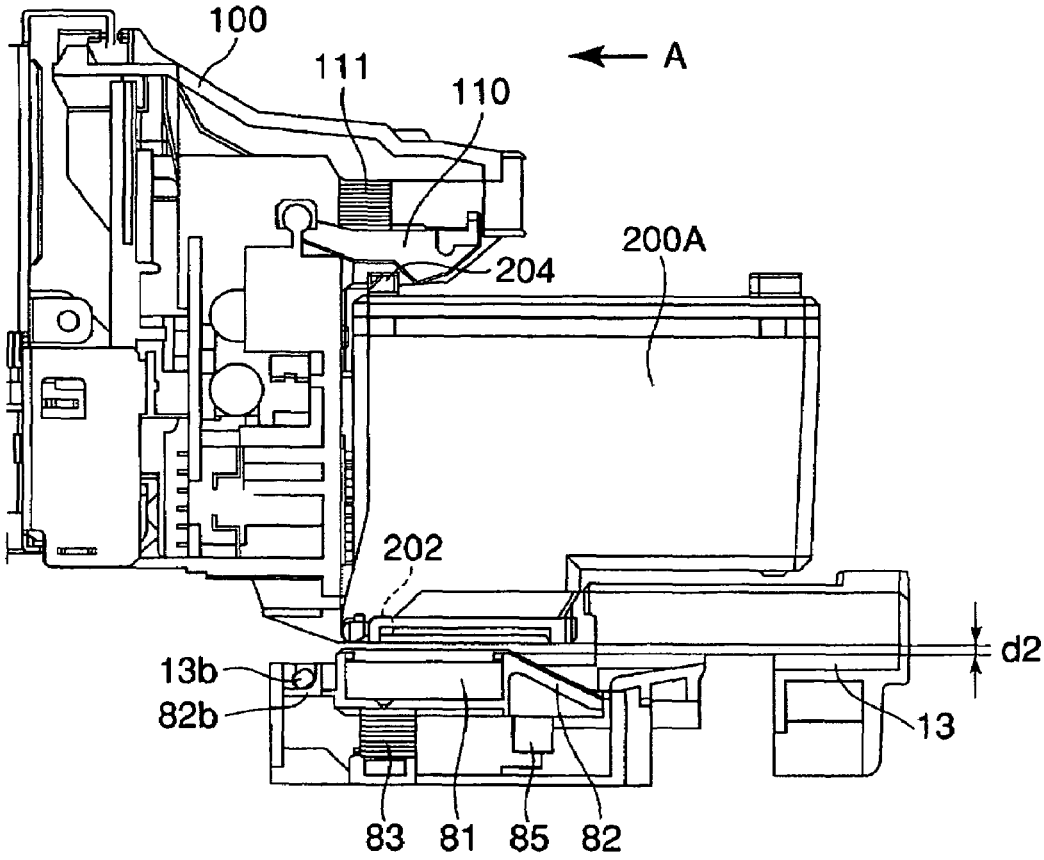
FIG. 9 is a section view showing a state in which the inkjet head cartridge has been attached.

As a result, under normal conditions, which are other than an operation of replacing the cartridge with a new one, the preliminary-discharge receiving unit 80 is held within the opening 13*a* in the head supporting base 13 while being urged in a direction adjacent to the carriage 100. In other words, the preliminary-discharge receiving unit 80 is disposed as close as possible to the nozzles 210, although the preliminary-discharge receiving unit 80 is not in contact with the recording head of each of the cartridges 200A and 200B attached on the carriage 100. The distance between the preliminary-discharge receiving unit 80 and the ink discharge surface 201 of each of the cartridges 200A and 200B is maintained to be a predetermined preliminary discharge distance d2, as shown in FIG. 9. As shown in FIGS. 8 and 9, the preliminary discharge distance d2 is smaller than the detachable/attachable moving distance d1 of the recording head described above.

As described above, the carriage 100 and the cartridges 200A and 200B can smoothly move when the carriage 100 on which the cartridges 200A and 200B are attached moves up to the preliminary discharge position because no obstacle is present in their paths. At the preliminary discharge position, the preliminary-discharge receiving opening 84 of the preliminary-discharge receiving unit 80 is arranged in the immediate vicinity of the nozzles 210.

Generally, it has been shown that the amount of ink mist generated during a preliminary discharge decreases with decrease in the travel distance of ink droplets through the air. As a result, the generation of ink mist can be reduced with decrease in the distance between the nozzles 210 and the waste-ink absorber 81. In other words, according to the exemplary embodiment, when a preliminary discharge is performed, the travel distance of ink droplets can be significantly reduced, and therefore, the generation of ink mist can be reduced.

The volume of the waste-ink absorber 81 is set so as to temporarily absorb waste ink produced by preliminary discharge. Therefore, the absorber holder 82 includes a ditch and/or an ink hole in the direction of the weight of the waste-ink absorber 81 so that waste ink absorbed in the waste-ink absorber 81 is guided to the lower main absorber (not shown). The preliminary-discharge receiving unit in the exemplary embodiment is also applicable to a case where the waste-ink absorber 81 has a relatively large volume that allows waste ink produced by preliminary discharge to be sufficiently absorbed.

A cartridge replacing operation in the structure in which the preliminary-discharge receiving unit 80 is disposed as close as possible to the nozzles 210 of the recording head is described next. An operation of attaching the cartridge 200A to the carriage 100 is described below with reference to FIGS. 3 to 9. To detach the cartridge 200A from the carriage 100, the reverse procedure is followed. The operation for the cartridge 200A is the same as that for the cartridge 200B. FIG. 7 illustrates a vertical section of the carriage 100 and the cartridge 200A when the cartridge 200A starts being attached to the carriage 100. FIG. 8 illustrates a vertical section of the carriage 100 and the cartridge 200A when the cartridge 200A is being attached to the carriage 100. FIG. 9 illustrates a vertical section of the carriage 100 and the cartridge 200A when the cartridge 200A is locked and secured to the carriage 100.

As shown in FIG. 7, when a user holds the cartridge 200A and inserts the cartridge 200A into the first cartridge attaching portion 100A in the carriage 100, the rough guide projections 203 go into engagement with guide ditches 105 of the carriage 100 without requiring the user to pay attention to the operation.

In this state, if the user moves his/her hand off the cartridge 200A, the cartridge 200A is held in a predetermined attitude without being rotated about the rough guide projections 203. In other words, in order to maintain the attitude of the cartridge 200A in the operation of attachment and detachment, a rear portion of the recording head which is provided relatively remote from a contact area of the ink discharge surface 201 in which the nozzles 210 is in contact with the head supporting base 13.

Then, when the cartridge 200A is pressed in the direction of arrow A of FIG. 7, the cartridge 200A comes into contact with the guide abutting portions 82*a* of the absorber holder 82. At this time, the guide abutting portions 82*a* of the absorber holder 82 is in contact with the nozzle protectors 211 of the cartridge 200A.

As a result, the nozzles 210 of the recording head are not in contact with the waste-ink absorber 81 and the absorber holder 82. The bearing 82*b* of the absorber holder 82 engages the boss 13*b* of the head supporting base 13, as described above, and the absorber holder 82 is urged in a direction adjacent to the carriage 100 by an urging force applied by the compression coil spring 83.

Therefore, as shown in FIG. 8, as the cartridge 200A is further inserted into the first cartridge attaching portion 100A, the guide abutting portions 82*a* of the absorber holder 82 comes into contact with the nozzle protectors 211 of the cartridge 200A, and the absorber holder 82 is rotated about the bearing 82*b* and pressed downward so that the absorber holder 82 can move in a direction remote from the carriage 100. At this time, the absorber holder 82 is urged toward the recording head of the cartridge 200A by an urging force applied by the compression coil spring 83. However, since the urging force of the compression coil spring 83 is relatively small to allow only the absorber holder 82 and the waste-ink absorber 81 to approach the carriage 100, the urging force does not block the operation of attachment and detachment when the cartridge is replaced with a new one.

When the cartridge 200A is further pressed in the direction of arrow A of FIG. 8 at the state shown in FIG. 8, the head press receiving portions 204 disposed at the upper portion of the cartridge 200A overcomes the urging force of the head set spring 111 and the dead center in the head pressing generated by the head set cam 110, and the cartridge 200A is further drawn in the first cartridge attaching portion 100A. When the cartridge 200A is rotated up to a position where the cartridge 200A is fully drawn by the head set cam 110, as shown in FIG. 9, the positioning slots 202 engage the positioning protrusion 101, and an upper abutting portion 205 of the cartridge 200A engages an engagement concave portion 121 of the carriage 100. Therefore, the cartridge 200A is attached to the carriage 100 with stability. In this attachment state, the electrical connection between the cartridge 200A and the pressure welding connectors 120 has been established.

Therefore, without requiring a user to pay attention to the operation, the cartridge 200A is positioned and secured in the state in which the recording head is set shown in FIG. 9 by being rotated. As shown in FIG. 9, when the cartridge 200A is secured, in the preliminary-discharge receiving unit 80, the absorber holder 82 pressed by the compression coil spring 83 is maintained at a predetermined position with respect to the head supporting base 13 by means of the position regulating surface 85*a*. Therefore, the preliminary-discharge receiving unit 80 does not block an operation of securing the cartridge 200A (200B) at a predetermined position and a moving operation during scanning of the carriage 100.

As described above, in the inkjet recording apparatus and the preliminary-discharge receiving unit 80 according to the exemplary embodiment, the absorber holder 82 for holding the waste-ink absorber 81 is rotatably disposed in the directions adjacent to and remote from the carriage 100, and the preliminary-discharge receiving unit 80 is in contact with another element other than the nozzles 210 of the recording head when the recording head is detached from and attached to the carriage 100. Therefore, the preliminary-discharge receiving opening 84 and the waste-ink absorber 81 can be very close to the nozzles 210 without damaging the nozzles 210, and therefore, the generation of ink mist during preliminary discharge can be reduced.

Furthermore, according to the inkjet recording apparatus in the exemplary embodiment, the position where the recording head is detached from or attached to the carriage 100 (position where the recording head is replaced with a new one) is disposed outside the recording operation area of the recording head and is substantially the same as the preliminary discharge position. Therefore, the preliminary discharge position can be set without preparing a new scanning area of the carriage 100 for the preliminary discharge, and as a result, the entire size of the recording apparatus can be reduced.

In the preliminary-discharge receiving unit according to the exemplary embodiment, the absorber holder 82 and the platen 29 are formed as separate elements. Alternatively, the absorber holder 82 can be formed integrally with the platen, with a waste-ink absorber for so-called borderless recording or with the main absorber. These alternatives also achieve the same advantageous effects as those described above.

In the exemplary embodiment, the structure in which the two cartridges 200A and 200B are attached to the carriage 100 is described as an example. The number of cartridges is not limited to two. The present invention is applicable to an inkjet recording apparatus that uses one or more cartridges, a color inkjet recording apparatus that uses multiple types of cartridges employing different colors of ink, a continuous tone inkjet recording apparatus that uses multiple types of cartridges employing different densities of ink in the same color, and a combination thereof. These apparatuses achieve the same advantageous effects as those described above.

The present invention is also applicable to a structure that uses a replaceable inkjet head cartridge in which a recording head is formed integrally with an ink reservoir (ink tank), a structure that includes a separate recording head and a separate ink tank such that they are connected to each other with a tube or the like for supplying ink disposed therebetween, and other structures that have any arrangement of the recording head and the ink tank. These structures achieve the same advantageous effects as those described above. In the case of an inkjet recording apparatus, the present invention is also applicable to an apparatus that uses an inkjet head cartridge that uses an electromechanical transducer (e.g., piezoelectric element). In particular, an inkjet recording apparatus that uses an inkjet head cartridge that uses a method of discharging ink by employing thermal energy achieves highly advantageous effects. This method realizes high-density and high-quality recording.

As described above, according to the exemplary embodiment of the present invention, the generation of ink mist can be reduced with a simple and inexpensive structure, and the crud inside the apparatus caused by ink mist and the deposition of ink mist on a recording medium can be suppressed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-127929 filed Apr. 26, 2005, which is hereby incorporated by reference herein in its entirety.

What is claimed is:

1. A recording apparatus comprising:

a carriage capable of reciprocating with respect to a recording medium;

a recording head including an ink discharge surface and detachably attached on the carriage, the recording head being movable such that the ink discharge surface is movable by a first moving distance in a direction of ink discharge when the recording head is detached from or attached to the carriage; and a preliminary-discharge receiving unit disposed at a position opposite the ink discharge surface when the recording head attached on the carriage moves to a preliminary discharge position for performing preliminary discharge, wherein a distance between the preliminary-discharge receiving unit and the ink discharge surface is smaller than the first moving distance, wherein the preliminary-discharge receiving unit is movable in the direction of the ink discharge, and wherein the preliminary-discharge receiving unit is in contact with the ink discharge surface and moving in a direction remote from the carriage when the recording head is detached or attached on the carriage.

2. The recording apparatus according to claim 1, wherein the preliminary discharge position and a position where the recording head is detached from or attached to the carriage are substantially equal to each other with respect to a direction of movement of the carriage.

3. The recording apparatus according to claim 1, wherein the recording head includes a nozzle protector protruding from the ink discharge surface in the direction of the ink discharge, the nozzle protector being in contact with the preliminary-discharge receiving unit when the recording head is detached or attached.

4. The recording apparatus according to claim 1, wherein the preliminary-discharge receiving unit includes a waste-ink absorber configured to absorb and hold an ink droplet discharged from the recording head, a holder configured to hold the waste-ink absorber, and an urging member configured to urge the holder in a direction adjacent to the ink discharge surface, and wherein the holder includes an abutting portion configured to be urged into contact with the recording head by an urging force applied by the urging member so as to maintain a distance between the ink discharge surface and the holder.

5. A preliminary-discharge system for allowing a recording head, detachably attached on a carriage that is capable of reciprocating with respect to a recording medium, to perform preliminary discharge, the preliminary-discharge system comprising:

a preliminary-discharge receiving subunit disposed at a position opposite an ink discharge surface of the recording head when the recording head moves to a preliminary discharge position for performing the preliminary discharge, wherein the recording head is movable such that the ink discharge surface of the recording head is movable by a first moving distance in a direction of ink discharge when the recording head is detached from or attached to the carriage, wherein a distance between the preliminary-discharge receiving subunit and the ink discharge surface being smaller than the first moving distance, wherein the preliminary-discharge receiving subunit is movable in the direction of the ink discharge, and wherein the preliminary-discharge receiving subunit is in contact with the ink discharge surface and moving in a direction remote from the carriage when the recording head is detached or attached.

6. A preliminary-discharge system according to claim 5, wherein the preliminary discharge position and a position where the recording head is detached from or attached to the carriage are substantially equal to each other with respect to a direction of movement of the carriage.

7. A preliminary-discharge system according to claim 5, wherein the preliminary-discharge system includes a waste-ink absorber configured to absorb and hold an ink droplet discharged from the recording head, a holder configured to hold the waste-ink absorber, and an urging member configured to urge the holder in a direction adjacent to the ink discharge surface, and wherein the holder includes an abutting portion configured to be urged into contact with the recording head by an urging force applied by the urging member so as to maintain a distance between the ink discharge surface and the holder.

8. A recording apparatus for recording by a recording head having a nozzle portion, comprising:

a carriage on which the recording head is removably attached and which is capable of moving within a predetermined area; and a preliminary-discharge receiving unit, provided at a position corresponding to a preliminary discharge position in the predetermined area, configured to receive waste ink discharged from the recording head, the preliminary-discharge receiving unit being movable in a direction of ink discharge which is remote from the carriage, wherein the preliminary-discharge receiving unit is in contact with a part of the recording head without contacting the nozzle portion and moves in the direction urged by the recording head when the recording head is attached to the carriage.

9. The recording apparatus according to claim 8, wherein the preliminary discharge position and a position where the recording head is attached to the carriage are substantially equal to each other with respect to a direction of movement of the carriage.

10. The recording apparatus according to claim 8, wherein the recording head includes the nozzle portion provided at an ink discharge surface of the recording head, and a nozzle protector protruding from the ink discharge surface in a direction of the ink discharge, the nozzle protector being in contact with the preliminary-discharge receiving unit when the recording head is attached to the carriage.

11. The recording apparatus according to claim 8, wherein the preliminary-discharge receiving unit includes a waste-ink absorber configured to absorb the waste ink discharged from the recording head, a holder configured to hold the waste-ink absorber, and an urging member configured to urge the holder in a direction adjacent to the ink discharge surface, and wherein the holder is provided with an abutting portion configured to be urged into contact with the recording head by an urging force applied by the urging member to maintain a distance between the ink discharge surface and the holder.

12. The recording apparatus according to claim 8, wherein the preliminary-discharge receiving unit comprises a supporting base for guiding the recording head when the recording head is attached to the carriage.

13. A recording apparatus for recording by a recording head having a nozzle portion, comprising:

a carriage on which the recording head is removably attached and which is capable of moving within a predetermined area; and a preliminary-discharge receiving unit, provided at a position corresponding to a preliminary discharge position in the predetermined area, configured to receive waste ink discharged from the recording head, the preliminary-discharge receiving unit being movable in a first direction remote from the carriage and a second direction which is opposite to the first direction, wherein the preliminary-discharge receiving unit is in contact with a part of the recording head without contacting the nozzle portion and moves in the first direction urged by the recording head, and then moves in the second direction, when the recording head is attached to the carriage.

14. The recording apparatus according to claim 13, wherein the preliminary discharge position and a position where the recording head is attached to the carriage are substantially equal to each other with respect to a direction of movement of the carriage.

15. The recording apparatus according to claim 13, wherein the recording head includes a nozzle for discharging ink provided at an ink discharge surface of the recording head, and a nozzle protector protruding from the ink discharge surface in a direction of the ink discharge, the nozzle protector being in contact with the preliminary-discharge receiving unit when the recording head is attached to the carriage.

16. The recording apparatus according to claim 13, wherein the preliminary-discharge receiving unit includes a waste-ink absorber configured to absorb the waste ink discharged from the recording head, a holder configured to hold the waste-ink absorber, and an urging member configured to urge the holder in a direction adjacent to the ink discharge surface, and wherein the holder is provided with an abutting portion configured to be urged into contact with the recording head by an urging force applied by the urging member to maintain a distance between the ink discharge surface and the holder.

17. The recording apparatus according to claim 13, wherein the preliminary-discharge receiving unit comprises a supporting base for guiding the recording head when the recording head is attached to the carriage.

* * * * *